US005215201A

United States Patent [19]

Seymour

[11] Patent Number: 5,215,201

[45] Date of Patent: Jun. 1, 1993

[54] RETRACTING SELF FASTENING TOWEL BAR

[76] Inventor: Paul F. Seymour, 1104 Stillwater Dr., Jupiter, Fla. 33458

[21] Appl. No.: 867,328

[22] Filed: Apr. 13, 1992

[51] Int. Cl.[5] ..... A47F 5/00

[52] U.S. Cl. ..... 211/123; 211/94; 211/105.6

[58] Field of Search ..... 211/105.5, 105.6, 105.1, 211/123, 94

[56] References Cited

U.S. PATENT DOCUMENTS

| | | | |
|---|---|---|---|
| 645,543 | 3/1900 | Birch | 211/105.6 |
| 841,062 | 1/1907 | Snyder | 211/105.6 |
| 849,124 | 4/1907 | Goldnamer | 211/94 |
| 850,363 | 4/1907 | Frankel | 211/94 |
| 1,132,190 | 3/1915 | Kohout | 211/94 |
| 2,045,942 | 6/1936 | Brody | 211/123 X |
| 2,451,110 | 10/1948 | Newman | 211/94 |
| 2,587,111 | 2/1952 | Cashen | 211/94 X |
| 2,698,094 | 12/1954 | Simpson | 211/123 X |
| 3,074,740 | 1/1963 | Zastrow | 211/105.6 X |
| 3,104,014 | 9/1963 | Piette | 211/123 |
| 3,335,872 | 8/1967 | Dodich | 211/94 X |
| 3,350,120 | 10/1967 | Hinrichs | 211/105.6 X |
| 3,954,182 | 5/1976 | McEvers | 211/105.3 X |
| 4,427,119 | 1/1984 | Savino | 211/94 |

*Primary Examiner*—Robert W. Gibson, Jr.

[57] ABSTRACT

A protracting and retracting towel bar for the hanging of towels in a kitchen cabinet comprising a multiple sided, elongated hollow core support section. A slot extends axially on one side and through both ends. A piston slides freely in the core having an extended bracket supporting multiple extending rods.

One end of said towel bar has the improving addition of a telescoping insert section. Said insert compresses a spring against a stop block and is then pinned in place. The telescoping section will compress into the core under manual pressure but will remain captivated upon release. In operation the towel bar is compressed into a cabinet space and released at the proper areas to self fasten. The design of the improved towel bar allows installation directly under the sink basin area of a kitchen cabinet, i.e., from the inner edge of the top door stile, back on an level plane to the back wall of said cabinet. This area being particularly pointed out as the most efficient for a towel bar. The mounting of the combined towel rod with the spring activated addition is accomplished by most anyone from outside the confines of a cabinet without the use of tools or fasteners. All major componants of the towel bar are made of plastic for smooth rust free operation. All being made by the economic extrusion and injection molding process. As an alternate embodiment the towel rods of the towel rod mechanism, as described, are substituted by an adopting bracket whereby a utility tray is removeably attached thereto. The towel bar thereby becomes a retracting tray for the storage of every day kitchen aids. All other features of the towel bar mechanism remain the same.

2 Claims, 3 Drawing Sheets

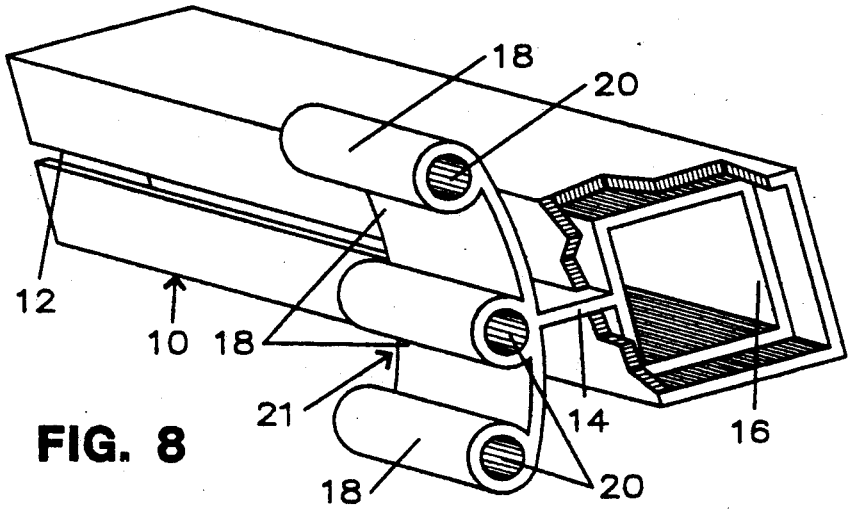
FIG. 8
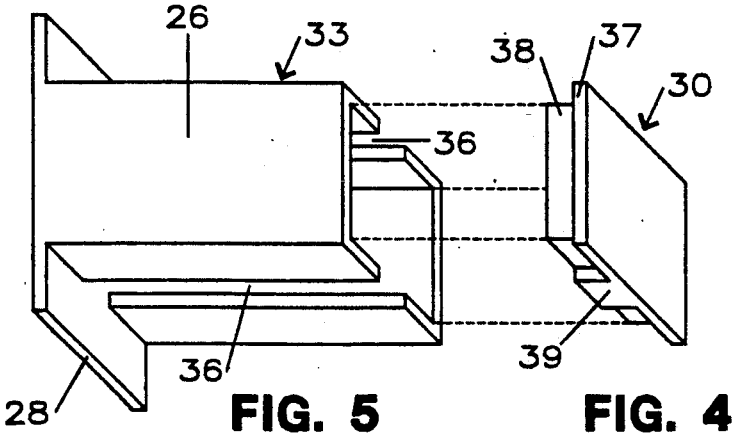
FIG. 5
FIG. 4
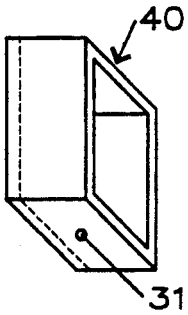
FIG. 6
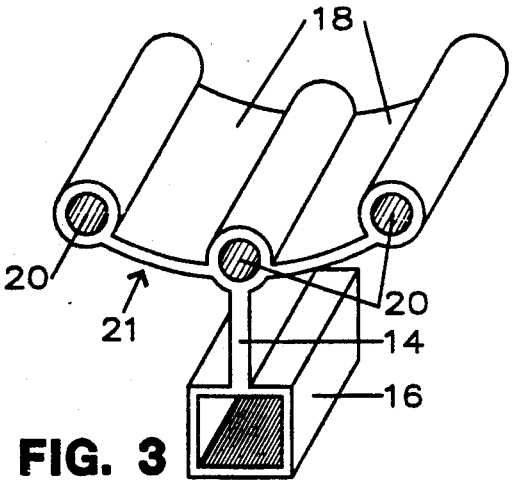
FIG. 3
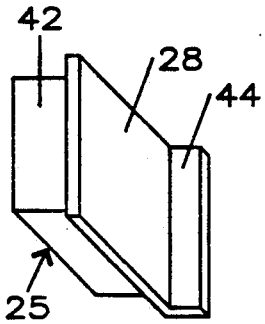
FIG. 7

RETRACTING SELF FASTENING TOWEL BAR

BACKGROUND OF THE INVENTION

Many kitchen cabinets are not equipped with a convenient retracting towel rod for hanging of wet towels and the like. Existing towel rods are expensive and difficult to install.

Prior art have retracting towel bars, some with two and others with three rods. One embodiment having rollers on tracks, others have gliders on guides. All perform one function; hanging towels in a cabinet for drying and retracting out of sight.

The prior art of the invention are made of metal, must be plated, are costly to product, and will rust with time.

All prior art to date must be fastened into a cabinet using tools and fasteners. Holes must be marked and drilled, and screws set in place. All this from inside the confines of a cabinet. Anyone who has worked inside a kitchen cabinet will understand the difficulties incurred.

Existing prior art requires a flat surface for mounting thereof which restricts it's use to vertical cabinet partitions; mounting thereby using valuable space. The vertical partitions are not always in the most convenient locations.

The design of prior art restricts the mechanism to one specific purpose only.

SUMMARY

These and other objects and advantages of the towel bar invention being disclosed herein.

The assembly of FIG. 1 is a view of my retracting towel bar showing the application of a telescopic, spring activated addition as part of it's structure.

Prior art has used a spring activated innovation in the past for expanding posts and rods. My invention relates to a protracting and retracting towel bar that eliminates the problems encontered in the field with past products.

It is therefore an object of the invention to provide an improved retracting towel bar made of plastic and rust free. All major componants being made by the economical process of extrusion and injection molding.

It is a further object of the invention to provide a method of installing the improved towel bar without the use of tools or fasteners.

It is a further object that the towel bar can be installed by anyone from outside the confines of a receiving cabinet.

It is another object of the invention that the towel bar can be installed directly under the sink basin. This area of mounting is particularly pointed as it is the most convenient to the work area; the mounting specifics being from the inner side of the top door stile, and on a level plane to the back wall of the cabinet.

It is a further object that the towel bar will adjust to variances in cabinet depths.

It is a further object of the invention that the towel bar mechanism as designed can be applied to other uses; such use being a retracting utility tray.

It is an object of the invention that the towel rods of the previously described towel bar besubstituted for a adoptive bracket whereby a utility tray is removeably attachable thereto. Said tray made of plastic will install under the sink basin area of a kitchen cabinet.

BRIEF DESCRIPTION OF THE DRAWING

FIG. 3 is a view of the sliding three winged towel rod bracket.

FIG. 4 is a view of the spring stop insert.

FIG. 5 is a view of the second tube showing the first cap with the extended sides together with the elongated slotted tube.

FIG. 6 is a detailed view of the stop block showing the fastening screw hole.

FIG. 7 is a view of the second cap showing the insert section, the extended sides and the positioning tab.

FIG. 8 is a view of the sliding towel rod assembly as it is inserted into the hollow core carrier.

DESCRIPTION OF THE PREFERRED EMBODIMENT

A self fastening retracting towel bar unit for a kitchen cabinet is disclosed. The towel bar unit includes a multiple sided elongated hollow housing having an inner first dimension with a first open end and a second open end. The housing having a longitudinal slot extending axially along one surface through both first and second ends.

The self fastening towel bar further includes an insert piston approximately two inches in length with an outer dimension less than the inner dimension of the housing for easy sliding engagement therein. Said piston having a protruding bar which fits through the said slot with easy sliding action. Said bar having multiple extending wings, each wing ending into a circular socket for the insertion of towel hanging rods. Said piston and it's componant parts molded of plastic into one integral part.

The self fastening towel bar further includes a telescoping end section under spring compression. This allows the towel bar unit to compress into a kitchen cabinet, and under manual pressure adjust to various cabinet depths. Release of manual pressure allows the towel bar to adhere to the front and back sections of the cabinet under spring pressure. The towel rods will slideably extend outside the cabinet and retract with hanging towels to be hidden behind the closed door.

The embodiment of the improved towel bar being applicable to other uses. The one preferred other use being a utility tray for under sink storage of every day kitchen aids. The utility tray embodiment replaces the towel rods. Said tray being detachable for easy cleaning.

An adoptive bracket provides the means whereby said utility tray is attachable to said towel bar embodiment. Said bracket comprising a plastic plate of a functional size having multiple protruding studs on one face. Said studs being of the same configuration as the towel rod sockets are a friction fit into said sockets. Opposing side of said bracket having a tapered slot at the top edge on a horizontal plane, said slot for attachment of said utility tray. The utility tray further includes a tapered bar at one top edge on a horizontal plane that meshes with said tapered slot; whereby said tray is removeably attachable thereto. The opposing end of said tray projects below the bottom edge as a finger pull whereby said tray is slideably deployed.

Figure 1:
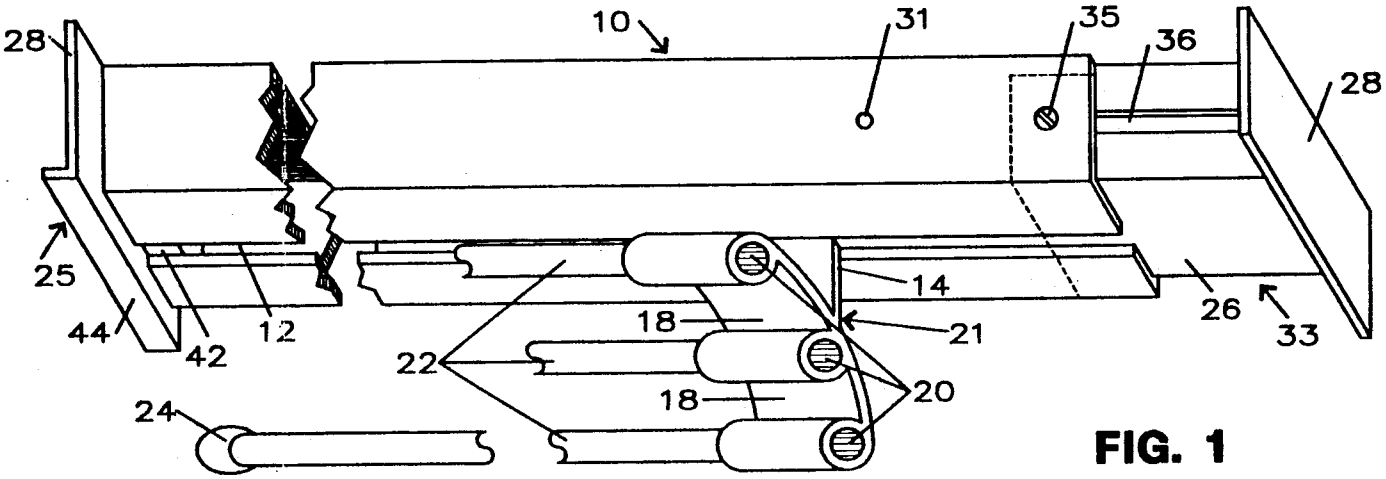
FIG. 1 is an overall view of the towel bar carrier with the invention improvements.
Figure 9:
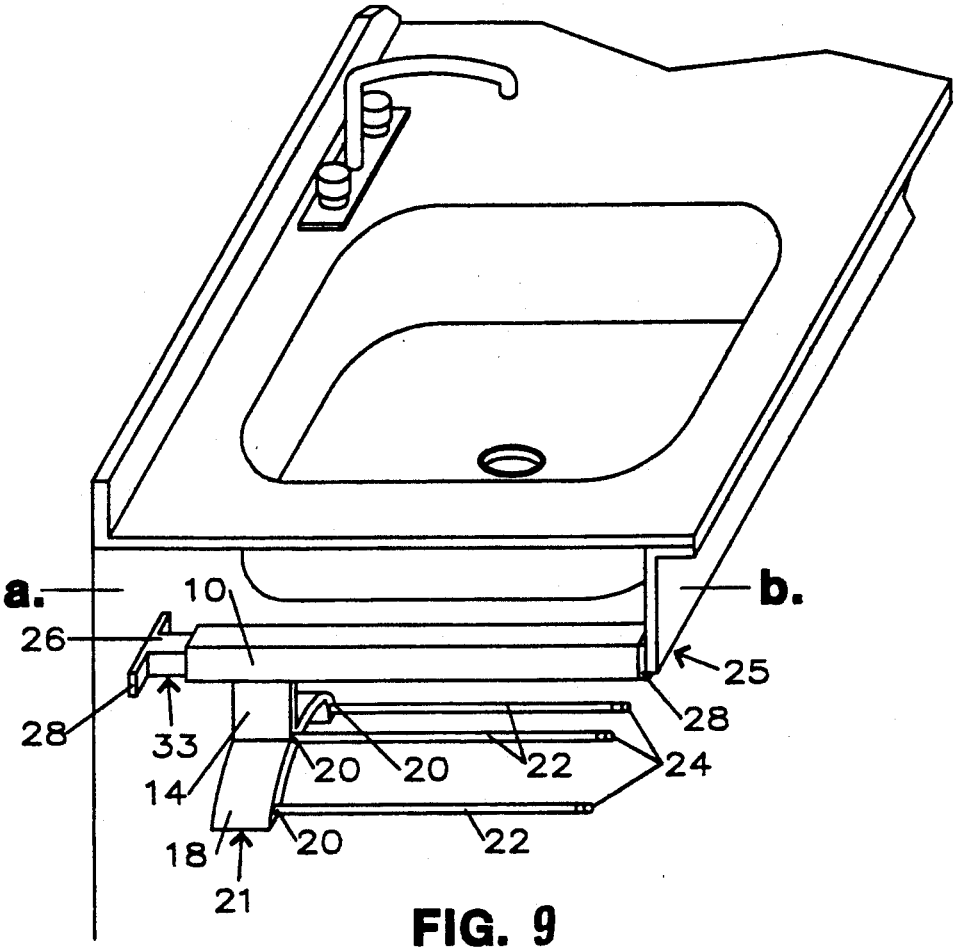
FIG. 9 illustrates a portion of a kitchen cabinet equipped with a self fastening towel rod carrier.

FIG. 1 shows a completely assembled self fastening towel bar and is shown installed in a kitchen cabinet in FIG. 9. The towel bar of FIGS. 1, 8 and 9 includes an elongated, hollow, multiple sided housing 10 having an inner first dimension. The housing 10 has a longitudinal slot 12 extending axially along one surface through both open ends. The bracket 21 of FIG. 3 is shown inserted into the housing 10 with the towel rods 22 set into the sockets 20. The caps 24 cover open ends of rods 22 and provide as finger pulls. The telescoping insert 33 of FIG. 1 is shown as being compressed and fastened in place by bolt 35. The towel bar further includes the insert 25 of FIG. 7. The section 42 having a friction fit enters second end of housing 10. The end cap surfaces 28 of FIGS. 5 and 7 being provided with a non slip means.

Figure 2:
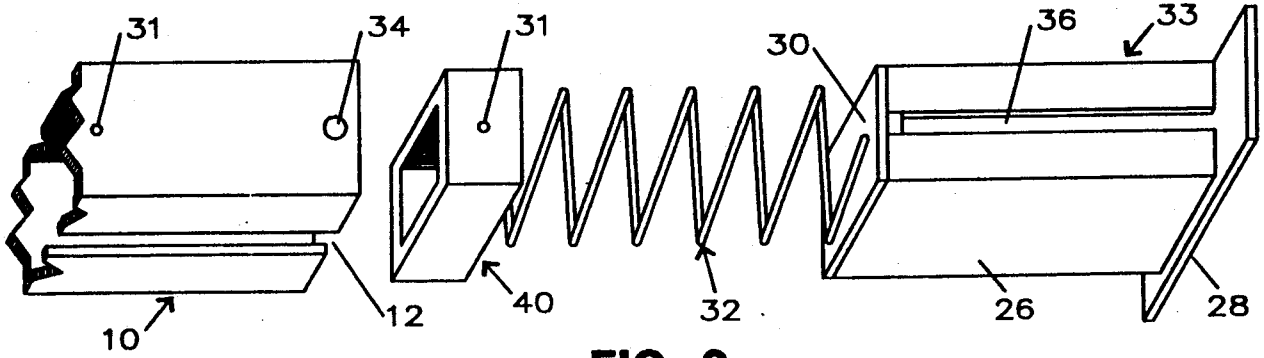
FIG. 2 is an exploded view of the componants with a section of the hollow core.

The self fastening towel bar further includes the telescoping section as shown in FIG. 2 which depicts the componants of FIGS. 4–5, and 6 together with the coil spring 32 in relative position. Block 40 of FIG. 6, which has one solid face, inserts into said first end of said housing 10 with said solid face outward. Said block 40 is fastened in place at pre-positioned screw hole 31. The stop 30 of FIG. 4 being cemented into open end of the tube 26 of FIG. 5. The spring 32, of proper length and tension, inserts into said first end of housing 10 and butts against said block 40. Said tube 26, with said stop 30 in place, compresses against said spring 32 whereby screw hole 34 and slot 36 of FIG. 2 are in alignment. A bolt 35 of FIG. 1 inserts into the hole 34 and through said slot 36 and continues through slot 36 and hole 34 of opposing side. The telescoping unit as assembled compresses manually whereby the compressed unit can be fitted to a kitchen cabinet.

As seen in FIG. 3 the towel bar further includes a three winged bracket 21. The insert piston 16 which has an outer dimension less than the inner dimension of said housing 10 for easy sliding engagement. The extending bar 14 having a cross sectional dimension which is less than the width of the slot 12 of hollow housing 10 for easy sliding engagement. The extending end of said bar 14 having wings 18 extending horizontally; each wing 18 ending in a circular socket 20 for insertion of towel hanging rods 22. The bracket 21 of FIGS. 1, 3, 8, 9 and 10 is molded of plastic into one integral unit.

As is seen in FIG. 9 a fully assembled towel bar of FIG. 1 is installed in a kitchen cabinet. The telescoping end 33 of the assembled towel bar is positioned against the back wall 'a' of the cabinet. The unit is manually compressed against the captivated spring 32 of FIG. 2 thereby allowing the end cap of FIG. 7 to slip behind cabinet stile 'b'. The tab 44 of FIG. 7 aligns the end cap 25 under the edge of said stile 'b'. Release of manual pressure allows the spring 32 to exert continuous pressure against slip free ends of caps 28 thereby securing the towel bar in a horizontal operating position. The bars 22 can now be deployed outside of the cabinet, towels hung thereon and retracted into said cabinet. Door can be normally closed.

Figure 10:
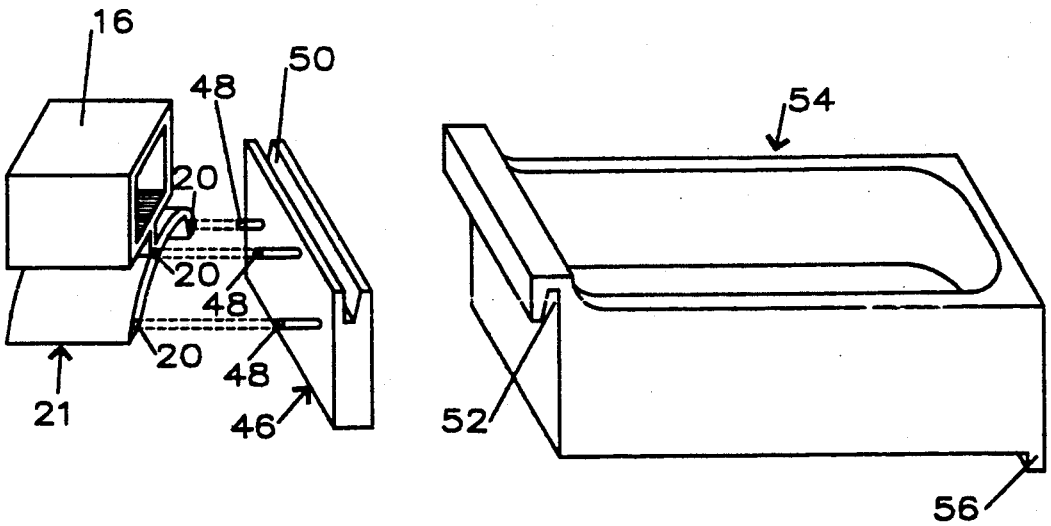
FIG. 10 is a detailed view of a removeable tray together with a hanging bracket as it is applied to the towel rod assembly and the carrier.

As seen in FIG. 10 an alternate use of the preferred embodiment of FIG. 1 being disclosed. The three winged bracket 21 of FIG. 3 is shown with the sockets 20 left open. A bracket 46 is included having protruding studs 48 which are compatable in size and configuration to the rod sockets 20 of said bracket 21 of FIG. 3. Said studs 48 being a friction fit into said sockets 20 thereby provide a secure attachment thereon. Opposing side of said bracket 46 having a tapered slot 50 at the top edge on a horizontal plane. As seen in FIG. 10 the utility tray 54 shows a tapered bar 52 across the upper edge of one end. Said tapered bar 52 and said tapered slot 50 being compatable in size and taper thereby provides secure interlocking of said tray 54 to said bracket 46; tray is detachable for cleaning. A tab 56 extending down from bottom edge of opposing end of said tray 54 provides a finger pull whereby said tray is deployed in or out of a cabinet. The size of said utility tray being approximately 4 inches wide by 10 inches long by 2½ inches deep. The bracket 46 being compatable in size to the end dimensions of said tray 54. The bracket 46 and the utility tray 54 being molded of a rigid plastic.

In the preferred embodiment, the outer dimension of the housing 10 is approximately 1¼ inches. The housing 10 has an axial length of approximately 21 inches, the tube 26 has an approximate length of 3½ inches, and the piston 16 has an approximate length of 2 inches. In the alternate embodiment the measurements of the preferred embodiment will prevail.

Although a specific and a alternate embodiment have been disclosed, it will be understood by those having skill in the art, that changes can be made in the details of each structure without departing from the spirit and scope of the invention.

NAMES OF PARTS AND INDENTIFICATION NUMBERS

10 hollow core tube
12 slot in hollow core
14 extending bar
16 insert piston
18 extending wings
20 rod sockets
21 three winged bracket
22 towel rods
24 finger pulls
26 telescoping section
28 extended caps
30 spring stop insert
31 screw hole
32 coil spring
34 retaining bolt hole
35 retaining bolt
36 retaining bolt slot
37 collar
38 insert section of spring stop 30
39 protruding lug (of 30)
40 stop block
42 cap insert
44 extending tab
46 adoptive hanging bracket
48 stud extrusions
50 tapered slot
52 tapered bar
54 utility tray
56 pull tab
'a' cabinet back wall
'b' cabinet door stile I hereby claim:

1. A self fastening, self adjusting, retracting towel bar for a kitchen cabinet comprising:

an elongated, multiple sided housing having an inner diameter of a first dimension, having a first open end and a second open end, with a longitudinal slot extending axially along one surface through both first and second open ends;

an insert piston of a functional length with an outer dimension less than the inner dimension of said housing, said piston enters said first end of said housing in axially slideable engagement therewith;

a bar having a cross sectional dimension less than the width of said slot in said housing, being an extension of said piston and projecting vertically from one side and through said slot in said housing in slideable engagement therewith;

a cross wing, centered on and horizontal to said projecting bar having spaced circular sockets for insertion of towel hanging rods therein;

said piston together with said extending bar, with wings and sockets being formed of plastic as one integral part;

said towel bar further comprising:

a telescoping end section which enters said first end of said housing with easy sliding engagement therein; said telescoping end having a extended cap with a adhereing means for positive contact in a cabinet installation;

a coil spring of a determined tension and length as inserted into said housing butts against a preset stop means therein;

a means whereby said telescoping end is locked in a partially inserted position in said housing and under constant pressure of said coil spring therein; whereby said towel bar may be further compressed into a cabinet and be self fastening thereto;

a extended second cap with a press fit into said second end of said housing, having a extended tab for accurate positioning in a cabinet;

whereby towels may be hung from extended towel rods and slideably retract into said cabinet and be concealed behind the closeable cabinet door.

2. A self fastening, self adjusting, retracting utility tray for protracting and retracting from under a kitchen sink for the storage of every day kitchen aids, comprising:

an elongated, multiple sided housing having an inner diameter of a first dimension, having a first open end and a second open end, with a longitudinal slot extending axially along one surface through both first and second open ends;

an insert piston of a functional length with an outer dimension less than the inner dimension of said housing, said piston enters said first end of said housing in axially slideable engagement therewith;

a bar having a cross sectional dimension less than the width of said slot in said housing, being an extension of said piston and projecting vertically from one side and through said slot in said housing in slideable engagement therewith;

a cross wing, centered on and horizontal to said projecting bar having spaced circular sockets for insertion of a adoptive bracket;

said bracket having a means on one side for attachment into said circular sockets;

a interlocking means is molded into opposing face of said bracket for attachment of said utility tray;

said utility tray having the same width as said adoptive bracket; one end of said tray having a projecting means which interlocks with said interlocking means of said bracket;

whereby said utility tray may be removeably attached to said bracket for easy cleaning.

* * * * *